United States Patent [19]

Kersten

[11] Patent Number: 4,652,202

[45] Date of Patent: Mar. 24, 1987

[54] LIFT MECHANISM

[76] Inventor: Donald J. Kersten, 5623 N. 68th Pl., Paradise Valley, Ariz. 85253

[21] Appl. No.: 727,343

[22] Filed: Apr. 25, 1985

[51] Int. Cl.[4] ..... B66F 7/22

[52] U.S. Cl. ..... 414/648; 414/649; 414/609; 414/118; 254/5 R; 254/3 R; 108/136; 271/147; 271/128; 271/217; 271/215

[58] Field of Search ..... 414/648, 649, 639, 640, 414/641, 656, 598, 118, 427, 119, 45, 43, 601, 602, 609, 673, 98; 254/5 R, 5 B, 5 C, 3 R; 271/214, 215, 217, 219, 24, 30.1, 128, 147

[56] References Cited

U.S. PATENT DOCUMENTS

| | | | |
|---|---|---|---|
| 1,426,116 | 8/1922 | Simons | 414/648 |
| 1,843,736 | 2/1932 | Remde | 414/639 X |
| 2,076,186 | 4/1937 | Reynolds . | |
| 2,381,743 | 8/1945 | Harred . | |
| 2,467,493 | 4/1949 | Pabich . | |
| 2,595,015 | 4/1952 | Sparus . | |
| 2,788,909 | 4/1957 | Kughler | 414/639 |
| 2,805,839 | 9/1957 | Branick . | |
| 2,806,607 | 9/1957 | Korngold et al. | 108/136 |
| 2,960,805 | 11/1960 | Herman . | |
| 3,067,885 | 12/1962 | Kohler . | |
| 3,123,023 | 3/1964 | Bronson | 414/118 X |
| 3,123,024 | 3/1964 | Bronson . | |
| 3,175,721 | 3/1965 | Smith | 414/639 |
| 3,476,404 | 11/1969 | Rachman | 414/640 X |
| 3,490,614 | 1/1970 | Wilson . | |
| 3,674,240 | 7/1972 | Larsson . | |
| 4,050,597 | 9/1977 | Hawkins | 414/641 X |
| 4,172,686 | 10/1979 | Shorthouse . | |
| 4,302,141 | 11/1981 | Miguel . | |
| 4,373,846 | 2/1983 | Charbonnet . | |

FOREIGN PATENT DOCUMENTS

| | | | |
|---|---|---|---|
| 580181 | 11/1977 | U.S.S.R. | 414/639 |

*Primary Examiner*—Frank E. Werner
*Attorney, Agent, or Firm*—LaValle D. Ptak

[57] ABSTRACT

A lift mechanism of a "fork-lift" type is capable of use on the input and output sides of machines for processing sheets of particle board, plywood and similar products. The mechanism itself has the sheets of product to be processed stacked on a pair of spaced-apart lifting arms which are hydraulically raised and lowered from one end, leaving the other end open to permit loading of stacks of product sheets or to permit removing stacks of product sheets from the arms by means of a conventional fork-lift truck. The lifting arms deflect under load in direct proportion to the amount of load on them, and a cam and cam-follower mechanism is provided to compensate for this deflection. Thus, the top sheet of the stack load always is presented at a horizontal orientation.

10 Claims, 4 Drawing Figures

FIG. 1
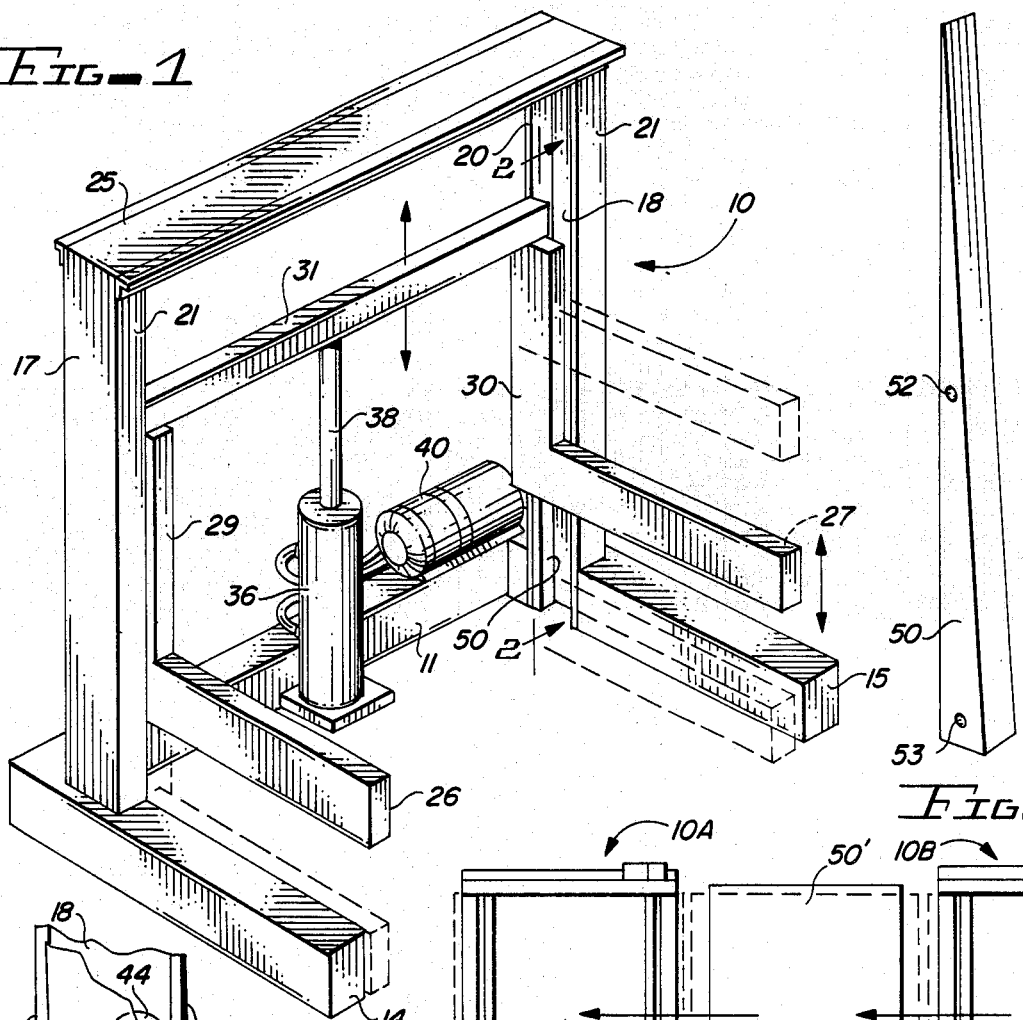
FIG. 4
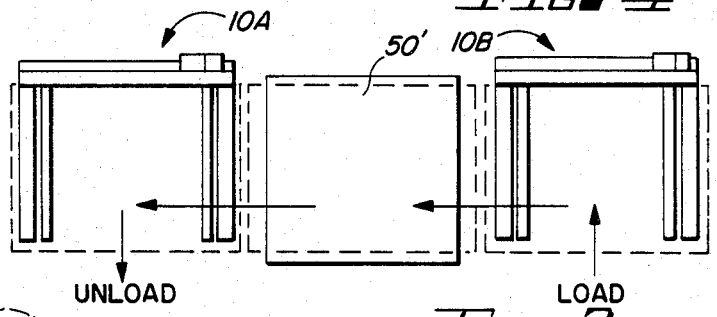
FIG. 3
FIG. 2
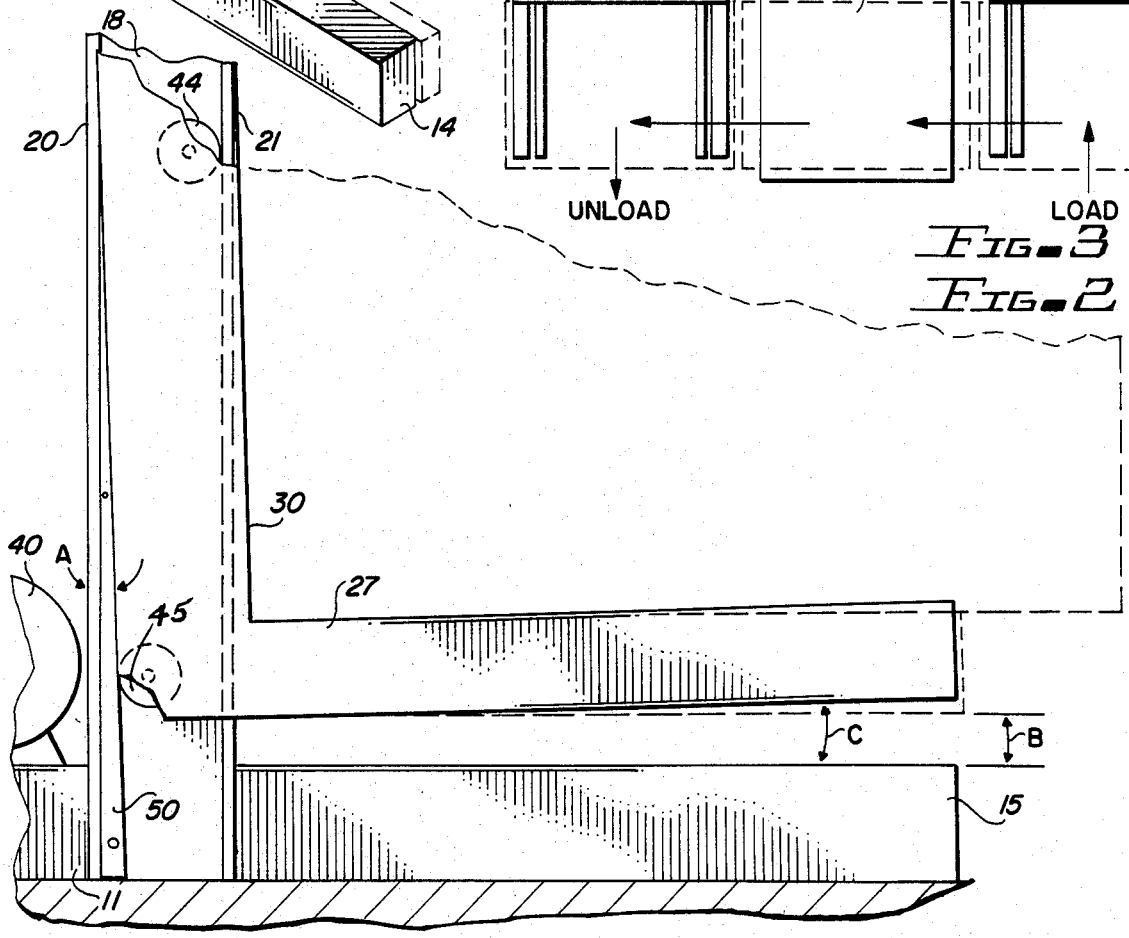

LIFT MECHANISM

BACKGROUND

Lift tables or lift elevator mechanisms are used in a number of different industries for presenting a stack of sheet materials to a work station or for receiving sheet materials from a work station and stacking them for subsequent removal to a storage or shipping facility. These lifts or elevators are used to raise a stack of sheet materials, so that the uppermost sheet in the stack always is presented to the work station at the same height. Similarily, when sheets are removed from a work station, the lift or elevator mechanism is lowered in a step-by-step manner; so that each new sheet which is transferred from the work station to the lift mechanism is transferred onto the top of the stack of previously-transferred sheets level with the top of the stack. Lift mechanisms are particularly suited for feeding large sheets of particle board, plywood, wallboard or the like onto a work station where the boards are cut, shaped, coated or otherwise acted upon prior to removal from the work station to another lift mechanism where the finished sheets of material are stacked.

In a typical factory environment a large stack of plywood sheets or the like are usually placed on a scissors lift table. The height of the table then is hydraulically or electrically adjusted by an operator and, as sheets are removed from the table onto the work station (or are removed from the work station onto a similar lift table at the receiving side), the operator usually uses a foot lever to raise (or lower) the lift mechanism to put the next sheet in the stack at the level from which it can be readily moved off the stack to the work station (or from the work station onto the receiving stack). These devices usually require the presence of an operator at all times and they are relatively cumbersome and expensive. In addition, the lifting mechanism is located directly beneath the lifting surface of the table and occupies a substantial amount of vertical space, even when the table is in its lowermost position. Consequently, there is a significant amount of space between the lowermost position of the lifting surface of the table and the floor which, in turn, limits the amount of material which can be stacked on the table for supply to or removal from a work station located adjacent the table. Patents which are typical of such scissors lift mechanisms are the patents to Kohler, U.S. Pat. No. 3,067,885, and Herman, et al., U.S. Pat. No. 2,960,805.

A slightly different approach, but one which also is subject to the disadvantages of the wasted space beneath the lifting surface present in the scissors lift devices, is described in the patent to Sparks, U.S. Pat. No. 2,595,015. This patent discloses a hydraulic lift system in which the hydraulic lift is located directly beneath the lift table. Because of this location, it is necessary to mount the hydraulic cylinder beneath the floor under the table. This is an expensive installation which, obviously, is inflexible once it is installed since it must remain in place in the position of the original installation.

Lift mechanisms or lift elevators which are capable of more efficient utilization of the vertical space between the floor and the lift surface are disclosed in the patents to Bronson, U.S. Pat. No. 3,123,024; Harred, U.S. Pat. No. 2,381,743; Pabich, U.S. Pat. No. 2,467,493; Shorthouse, U.S. Pat. No. 4,172,686; Larsson, U.S. Pat. No. 3,674,240; Charbonnet, U.S. Pat. No. 4,373,846; and Wilson, U.S. Pat. No. 3,490,614. The Bronson patent discloses a spring-operated leveling device of the type used in restaurants for presenting racks of dishes to a uniform work height (such as for a dishwasher or the like). The lift arms of the elevator mechanism are supported by a pair of spaced rollers bearing against opposite sides of a guide channel formed by a pair of upright members 17 of the mechanism. This roller arrangement permits the load to be held on cantilevered arms or a cantilevered platform while it moves vertically on the rollers confined within the guide channel.

The rest of the patents mentioned in the preceding paragraph are directed to elevator-type mechanisms for transferring sheet material from stacks to a uniform work height. Several of these patents disclose the use of a sensing switch to locate the position of the top sheet in the stack. All of these patents disclose the use of either hydraulic lifts or other types of mechanical mechanisms, such as chains or cables, to vertically move a pair of spaced-apart lift arms or a lower lift panel underneath the stack of articles to be presented to the work station.

For those patents of this group which disclose cantilevered spaced-apart arms or a cantilevered platform for lifting the load, the various mechanisms are capable of the necessary step-by-step incremental positioning of the load as articles are removed through it under the control of the "top article" sensing switch. None of these patents, however, provide any means for compensating for deflection or bending of the cantilevered lift arms or platform under the weight of the load. It is possible, for example, when plywood sheets constitute the load, for the load to be extremely heavy and to cause a relatively large deflection of the ends of the cantilevered lifting arms when they are subjected to a full load or nearly full load. Consequently, compensation in the form of additional mechanisms or guide surfaces or the like must be provided on either the work station or the lift mechanism or both to adjust the position of the top sheet being transferred to the work station, depending on how many sheets constitute the load on the lift mechanism at any given time. As the load is removed sheet-by-sheet from the lift mechanism, it raises; and, as the weight diminishes, the deflection or bending of the lift arms also diminishes. Accordingly, it has been difficult to provide close tolerances whenever heavy loads are being transferred from the lift table. In addition, it has been difficult to provide accurate automatic sensing of the top sheet relative to the work table, since the orientation of the top sheet varies as the load varies, unless extremely heavy-duty lift arms and corresponding heavy-duty hydraulic systems are employed simply to overcome the potential for a bending deflection of the lift arms by brute force.

Another shortcoming of the patents which have been discussed above is that many of them are incapable of being loaded and unloaded by the fork-lift trucks used extensively throughout industry today. Those which can be loaded by means of a fork-lift truck do not present a clear area at ground level; so that the lift arms of the fork-lift truck cannot deposit stacks of materials onto the lift mechanism unless the materials are placed on a spacer or pallet.

Accordingly, it is desirable to provide a lift mechanism or lift table which is not subject to the disadvantages of the prior art discussed above. More specifically, it is desirable to provide a lift table which is capable of presenting the top sheet of the load at the same orientation (preferably horizontal) irrespective of the number of sheets or articles which are stacked on the lift mechanism at any given time. It also is desirable to provide a lift table or lift mechanism which readily can be loaded and unloaded by a standard fork-lift truck.

SUMMARY OF THE INVENTION

It is an object of this invention to provide an improved lift mechanism.

It is an additional object of this invention to provide an improved lift table for use in transferring materials to or from a work station at a given height.

It is another object of this invention to provide an improved lift mechanism capable of being loaded and unloaded by a standard fork-lift truck.

It is a further object of this invention to provide an improved lift mechanism which compensates for the deflection of cantilevered lift arms as the weight of the load varies.

In accordance with a preferred embodiment of this invention, a lift mechanism includes a frame member and a load-lifting platform. A lift mechanism is coupled with one end of the load-lifting platform to raise and lower it. The load-lifting platform and the frame are interconnected by a device for maintaining a load on the load-lifting platform level, compensating for deflection of the load-lifting platform caused by the weight of a load on the platform.

The frame and the load-lifting platform are constructed with an open side to permit placing of a load on the load-lifting platform and removal of a load from the platform by means of a standard fork-lift truck without the necessity of requiring a pallet or spacer.

BRIEF DESCRIPTION OF THE DRAWING

FIG. 1 is a front perspective view of a preferred embodiment of the invention;

FIG. 2 is a side view taken along the line 2—2 of FIG. 1;

FIG. 3 is a top view of an orientation of a typical work station in conjunction with the mechanism shown in FIGS. 1 and 2; and FIG. 4 is a detail of one of the features of the invention.

DETAILED DESCRIPTION

Reference now should be made to the drawing in which the same or similar components have the same reference numbers throughout the different figures. FIG. 1 illustrates a preferred embodiment of a lift mechanism or lift table 10 made in accordance with the invention. This lfit mechanism comprises a base including a rear frame member 11 and a pair of spaced parallel feet members 14 and 15 extending perpendicularly from the opposite ends of the rear frame member 11. The configuration formed by the member 11 and the feet 14 and 15 is a generally "U" shaped configuration which is open at the forward or loading end. Near the junction of the feet 14 and 15 with the rear member 11, a pair of vertical beams 17 and 18 are attached. These vertical beams may be of "I"-beam construction or in the form of box-beams, as shown, with a channel formed on the inward or facing sides of the beams 17 and 18 by a pair of parallel flanges 20 and 21 on each of the beams. The flanges 20 and 21, in conjunction with the beams 17 and 18 of which they are a part, form guide channels for the lift-loading platform or lift-loading arms of the lifting mechanism.

To provide stability and additional rigidity to the mechanism, a top plate 25 is attached across the upper ends of the beams 17 and 18 to complete a rigid frame for supporting and holding the load-lifting platform of the mechanism.

As illustrated in FIGS. 1 and 2, the load-lifting platform is of the type utilized in fork-lift devices of various types. It constitutes a pair of spaced-apart, parallel cantilevered lifting arms 26 and 27, the top edges of which lie in the same plane. These arms, in turn, are attached to and supported at the rear ends thereof by a pair of vertical members 29 and 30 which are connected to a horizontal cross member 31 at the upper ends. This is shown most clearly in FIG. 1. The outer ends of the arms 26 and 27 are free, so that the space between the arms 26 and 27 is open. When the arms 26 and 27 are in their lowest position (shown in dotted lines in FIG. 1), the plane of the upper surfaces of the arms 26 and 27 is either co-planer with the upper surfaces of the feet 14 and 15 or is slightly below the plane of the upper surfaces of the feet 14 and 15.

Elevation or lifting of the arms 26 and 27 to different vertical positions is accomplished by means of a hydraulic cylinder 36, which moves a piston 38 attached at its upper end to the center of the horizontal member 31 to cause the member 31 to be moved up and down, as indicated by the arrows in FIG. 1. A motor/pump 40 of conventional construction is used to operate the cylinder 36 under the control of signals (from a source not shown) supplied to the motor/pump 40. FIG. 1 illustrates, in dotted lines, the upper and lower positions of the load-lifting arms 26 and 27 which function to provide a load-lifting platform for the lift mechanism.

To guide the vertical travel of the load-lift arms 26 and 27, each of the vertical members 29 and 30 has a pair of guide rollers mounted on it. The guide rollers for the member 30 are illustrated in dotted lines as rollers 44 and 45 in FIG. 2. These rollers are on the outside of the vertical members 29 and 30. The roller 44 is located near the forward edge and the roller 45 is located near the rear edge of the corresponding members 29 and 30. The rollers 44 and 45 may be of any suitable type, and the roller 44 bears against the flange 21 and the roller 45 bears against the flange 20 of the beams 17 and 18. As increased weight is placed on the arms 26 and 27, the force with which the rollers 44 and 45 bear against the flanges 21 and 20, respectively, increases. Thus, the rollers 44 and 45, along with the flanges 21 and 20, are subjected to considerable forces, depending upon the weight of the load placed on the arms 26 and 27. When the load is $\frac{3}{4}$" plywood sheets or the like with large numbers of sheets being placed on the table, this weight can be significant.

The device which has been described thus far is capable of raising and lowering loads placed on the lifting arms 26 and 27 of the lift mechanism to present such loads to a work station. The sheets of material constituting such loads either are removed one at a time from the top of the stack or are supplied one at a time to the top of the stack, if the mechanism is used as a receiving table. Various additional controls and mechanisms may be utilized to effect automatic positioning of the top sheet in a stack of materials to a desired work position and for moving sheets of materials to and from a work station. Since such controls and mechanisms are employed with lift tables currently in commercial production and do not form a part of the invention here, they have not been shown in order to avoid cluttering of the drawing. It is to be understood, however, that such automatic controls typically will be employed with the lift mechanism illustrated in the drawing.

It has been found, however, that when heavy materials, such as 4'×8'×¾" plywood sheets and the like, are handled by a lift mechanism, such as shown in FIG. 1, the fork-lift or cantilevered lifting arms 26 and 27 undergo a considerable bending deflection when a maximum load is placed on them. As the load is lessened (for example, when the sheets comprising the load are stripped away, one at a time), this bending deflection changes and becomes less until it is at a minimum when the final sheet of a stack of materials is removed from the arms 26 and 27. For many applications, the deflection can be as much as ¾" to 1" when a full load or nearly-full load is on the lifting arms 26 and 27. This creates considerable problems in adjusting the top sheet for presentation to a work station and, in the past, has required an operator to be present to manually operate controls for changing the position of the cross member 31 to precisely locate the top sheet for presentation to a work station. One way of overcoming this tendency of the arms 26 and 27 to bend or deflect under a heavy load is to make all of the lifting structure of extremely heavy-duty material. This, in turn, however, enormously increases the cost of the machine and requires substantially larger hydraulic components and power components.

To compensate for the bending deflection of the arms 26 and 27 under a full load, a triangular-shaped elongated cam wedge 50 is attached to the inside surface of the flange 20 on each of the beams 17 and 18. This triangularly-shaped cam wedge 50 is shown most clearly in FIGS. 2 and 4. The base or widest part of the cam 50 is at the bottom of the flange 20 at it tapers linerally to an apex or point located below the highest point reached by the rollers 45 in the operation of the lift mechanism. As illustrated in FIG. 2, the cam 50 provides an angle "A" from vertical in the channel formed between the flanges 20 and 21.

The particular angle "A" of the cam 50 is selected in accordance with the characteristics of the load which is to be handled in any given operation by the lift mechanism. For example, if ¾" plywood sheets comprise the load, each of those sheets has a specific weight. Removal of each sheet from the load stack (or addition of a sheet to such a load stack) causes the weight of the total load to be reduced by a readily defined specific amount. If 20 sheets are placed on the arms 26 and 27 for a full load, removal of each sheet removes one-twentieth of that total load.

Analysis of the manner of operation of the lift mechanism shows that the weight of the load is the most when the arms 26 and 27 are in their lowest position and is the least when the arms 26 and 27 are in their highest position (shown in dotted lines in FIG. 1). Furthermore, the relationship is linear, i.e., is for each increment of elevation effected by means of the hydraulic cylinder 36, a specific amount of load is either removed from or added to the weight on the arms 26 and 27. Since this is a linear increment of weight, a linear cam 50 is utilized to cause the arms 26 and 27 to be deflected or tipped upwardly (as viewed at their outer or free ends) a maximum amount when the arms 26 and 27 are in their lowest position and to be deflected a minimum amount, to their normal horizontal position, when the load is at its minimum. This minimum load exists when the final sheet either is removed from the load or the first sheet is added to the load (in the case of a receiving lift table from a work station).

Once the weight of the load has been determined in conjunction with the physical characteristics of the materials out of which the lift mechanism has been made, a cam 50 having a specific angle "A" is installed, as described, to compensate for the bending deflection of the arms 26 and 27. As illustrated in FIG. 2, the normal horizontal position of the arms 27 and 26 in the position shown in the drawing would be as illustrated in dotted lines, with a distance "B" between the lower edge of the arm 27 and the upper edge of the foot 15. The cam 50, however, tilts the lift platform or plane formed by the upper surfaces of the arms 26 and 27 to the solid line position, shown in FIG. 2, providing a distance "C" between the lower edge of the arm 27 and the upper edge of the foot 15.

When sheets of different materials, having a different weight per sheet, are to be handled by a lift mechanism of the type shown in FIG. 1, a different cam 50 having a different angle "A" from the one used for the load described above, for example, may be employed. It is a simple matter of mathematical computation to determine the amount of the angle "A" necessary, and the cam 50 readily may be removed and replaced with a cam having a different angle "A". Alternatively, the cam 50 may have a fixed angle; and shims may be used between the cam 50 and flange 20 to change the angle "A" to the desired angle. To facilitate installation and removal of the cams 50, they may be held in place by a pair of bolts fastened through holes 52 and 53 to hold the cams 50 against the inner surface of the channels formed between the flanges 20 and 21 on the beams 17 and 18. No force is applied to the cams 50 in the direction in which they are mounted, so that the mounting can be relatively simple. If there is never going to be a change of the type of sheet material which is to be handled by the mechanism, the cams 50 may be non-removably installed, although this is not necessary.

Another feature of the invention, which is apparent from an examination of FIG. 1, is that the load or stack of materials which is to be handled by the lift mechanism may be loaded onto and removed from the lift mechanism by a standard fork-lift truck, the lifting forks of which are spaced apart a distance less than the distance between the inner surfaces of the arms 26 and 27. The truck then may drive directly into the open side of the mechanism (the right-hand side illustrated in FIG. 1) and either deposit a load onto the arms 26 and 27 when they are in their lowest position or remove a load from the arms 26 and 27. To further show the manner in which this is accomplished, a typical arrangement of a pair of lift mechanisms 10A and 10B in conjunction with the work station 50' is illustrated in FIG. 3.

The lift mechanism 10A, shown on the right-hand side of the work station 50' in FIG. 3, is the input station. As illustrated, lift mechanism 10A is loaded from the side in the direction of the arrow on the lower edge of FIG. 3 to place a stack of sheet materials on the arms 26 and 27. These materials then are lifted one-by-one or incrementally into position and shifted from the top of the stack onto the work station 50', where various operations such as cutting, shaping, painting, and the like may be effected.

The sheet material is then removed from the work station 50' and loaded onto the lift mechanism 10B at the left-hand side of the work station, as shown in FIG. 3. The lift mechanism 10B is in its highest position when the first sheet is transferred to it from the work station. By the time the load has been completely removed from the mechanism 10A, the mechanism 10B is in its lowest position, having received all of the sheets which formerly were on the input or lifting mechanism 10A on the right of the work station 50'.

Once all of the sheets have been transferred from the mechanism 10A to the mechanism 10B, they may be unloaded by a fork-lift truck from the mechanism 10B, and the operation is repeated for a new load placed on the mechanism 10A. This ability to utilize a standard fork-lift truck to freely move a stack of materials, such as a stack of plywood sheets, onto the lift mechanism 10 and to remove such a stack from a lift mechanism 10 without any interference from the parts of the lift mechanism and without the requirement of a pallet or spacer further enhances the utility of the lift mechanism which has been illustrated and described.

Various changes and modifications will occur to those skilled in the art without departing from the scope of the invention. For example, although hydraulic controls have been indicated for raising and lowering the lift arms 26 and 27, other types of controls using motors, cables, chains, gears and the like may be employed as well. The particular configuration of the frame and the lift mechanism also may be varied without departing from the scope of the invention. Also, the cam 50 and the rollers 44 and 45 may be reversed in position, with the cams being placed on the vertical members 29 and 30 and the rollers being attached to the beams 17 and 18 along with appropriate modifications in the flanges and configurations of the engaging parts. The function of such a modified device is the same as described above. Other changes also may be made without departing from the scope of the invention.

I claim:

1. A lift mechanism including in combination:

a frame member having at least one linear vertical column attached to a base portion adapted to rest on a support surface;

cantilevered, low-lifting platform means having first and second ends and adapted for carrying a load, the weight of which varies inversely in direct proportion to the height of said platform means;

lift means coupled with the first end of said load-lifting platform means for raising and lowering said load-lifting platform means, the second end of said load-lifting platform means being deflected downwardly by said load in amounts directly proportional to the weight of said load; and an inclined face cam means and cam follower means interconnecting said load lifting platform means and said vertical column of said frame member for supporting said platform means on said vertical column of said frame member and for maintaining level said load on said load lifting platform means, said cam means being on one of said load lifting platform means and the vertical columm of said frame member and said cam follower means on the other of said load-lifting platform means and the vertical column of said frame member, said cam means and said cam follower means operating to pivot upwardly the second end of said load-lifting platform means in an amount to compensate for the downward deflection of the second end of said load-lifting platform means as said deflection varies in response to variations in the weight of said load thereon.

2. The combination according to claim 1 wherein said load-lifting platform means comprises a load-bearing member having said first and second ends; at least one vertical member having an upper end and a lower end, said lower end attached to said load-bearing member at the first end thereof and located adjacent said vertical column of said frame member; and said lift means is coupled to the upper end of said vertical member.

3. The combination according to claim 2 wherein said vertical column of said frame member includes first and second spaced-apart vertical parallel flanges located in planes parallel to the first end of said load-lifting platform means; and said vertical member is located adjacent said first and second flanges, with said cam located on one of said flanges and said vertical member and said cam follower located on the other of said vertical member and said one of said flanges.

4. The combination according to claim 3 wherein said cam follower means comprises upper and lower spaced-apart rollers, with the upper roller mounted near an edge of said vertical member nearest said first flange and the lower roller mounted near an edge of said vertical member nearest said second flange, said upper and lower rollers extending into the space between said first and second flanges, with said upper roller engaging said first flange and said lower roller engaging said second flange; and wherein said cam means comprises an elongated generally triangular-shaped wedge mounted adjacent said second flange in the space between said first and second flanges for engagement by said lower roller.

5. The combination according to claim 4 wherein said cam wedge has the base thereof located at the bottom and the apex thereof located at the top.

6. The combination according to claim 5 wherein said lift means comprises a hydraulic lift mechanism.

7. The combination according to claim 1 wherein said frame member has first and second spaced-apart vertical columns attached to said base portion, each of said columns having first and second parallel flanges extending along the length thereof; wherein said lifting platform means has corresponding first and second vertical members, each having an upper end and a lower end, located adjacent said first and second vertical columns, respectively, said vertical members being attached at the lower ends thereof to the first end of said lifting platform means; said lift means is coupled to the upper ends of said vertical members; respectively and said means for interconnecting said load-lifting platform means and said frame member comprises means for interconnecting said first vertical column of said frame member with the first vertical member of said load-lifting platform means and for interconnecting said second vertical column of said frame member with said second vertical member of said load-lifting platform means.

8. The combination according to claim 7 wherein said means for interconnecting said load-lifting platform means and said frame member comprises first and second cam and cam-follower sets, with a cam of said first set located on one of said first vertical member and one of said flanges on said first vertical column and a cam-follower of said first set located on the other of said first vertical member and said one of said flanges of said first vertical column, a cam of said second set located on one of said second vertical member and one of said flanges of said second vertical column and a cam-follower of said second set located on the other of said second vertical member and said one of said flanges on said second vertical column.

9. The combination according to claim 8 wherein said cam followers of said first and second sets each comprise upper and lower spaced-apart rollers, with the upper roller of each set mounted near an edge of said corresponding first and second vertical member nearest said first flange; and the lower roller of each set mounted near an edge of said corresponding first and second vertical member nearest said second flange; said upper and lower roller on each of said first and second vertical members extending into the space between the first and second flanges on said first and second vertical columns, respectively, with each of said upper rollers engaging the first flange of the corresponding vertical column and each of said lower rollers engaging the second flange of the corresponding vertical column; and wherein said cams of each of said first and second sets each comprise an elongated, generally triangular-shaped wedge, mounted adjacent the corresponding second flange in the space between said first and second flanges of said first and second columns for engagement by said lower rollers on said first and second vertical members, respectively.

10. The combination according to claim 9 wherein said cam wedges have the bases thereof located at the bottom and the apexes thereof located at the top when said wedges are mounted adjacent the corresponding second flanges of said first and second vertical columns.

* * * * *